US005878320A

United States Patent [19]

Stemmle

[11] Patent Number: 5,878,320

[45] Date of Patent: Mar. 2, 1999

[54] CONTINUOUS IMAGING OF A CONTINUOUS WEB SUBSTRATE WITH A SINGLE PRINT ENGINE WITH A PHOTORECEPTOR BELT SEAM

[75] Inventor: Denis J. Stemmle, Milford, Conn.

[73] Assignee: Xerox Corporation, Stamford, Conn.

[21] Appl. No.: 941,851

[22] Filed: Sep. 30, 1997

[51] Int. Cl.[6] ..... G03G 15/00; G03G 15/16

[52] U.S. Cl. ..... 399/384; 399/66; 399/163; 399/387; 399/396; 226/29

[58] Field of Search ..... 399/384–387, 399/396, 66, 297, 394, 102, 103, 165

[56] References Cited

U.S. PATENT DOCUMENTS

| | | | |
|---|---|---|---|
| 3,548,783 | 12/1970 | Knapp | 118/224 |
| 3,940,210 | 2/1976 | Donohue | 355/14 |
| 4,596,457 | 6/1986 | Peeters et al. | 355/14 R |
| 4,657,369 | 4/1987 | Takeuchi | 355/3 BE |
| 5,455,656 | 10/1995 | Covert et al. | 355/207 |
| 5,506,660 | 4/1996 | Rabb et al. | 355/208 |
| 5,519,230 | 5/1996 | Hubble, III et al. | 250/559.36 |
| 5,557,383 | 9/1996 | Hasegawa et al. | 355/271 |
| 5,568,245 | 10/1996 | Ferber et al. | 355/309 |
| 5,581,327 | 12/1996 | Izumizaki et al. | 355/208 |
| 5,629,775 | 5/1997 | Platteter et al. | 358/296 |
| 5,678,138 | 10/1997 | Kobayashi et al. | 399/18 |

FOREIGN PATENT DOCUMENTS

| | | |
|---|---|---|
| WO9602872A1 | 2/1996 | WIPO . |
| WO 96/14605 | 5/1996 | WIPO . |

OTHER PUBLICATIONS

Xerox Disclosure Journal, vol. 9, No. 3, May/Jun., 1984, pp. 201–203 Method For Duplex Printing On Continuous Web Paper, by: E. McIrvine.

*Primary Examiner*—R. L. Moses
*Assistant Examiner*—Shival Virmani

[57] ABSTRACT

A continuous web substrate printing system which can utilize a single otherwise conventional or existing xerographic print engine (normally printing conventional cut sheet print substrates) having an endless photoreceptor belt with a belt seam requiring a section of that belt to be unimaged in each belt rotation, yet provide continuous directly abutting images on the printed web, to avoid paper scrap. A special simplex or duplex continuous web printing substrate supply module may be docked with the cut sheet print engine to form an integral web printing system. It has a web feeding and image transfer system for appropriately feeding the continuous web printing substrate uncut into the print engine for image transfers to one or both sides of the web from the imaging surface of the print engine. For duplex printing a controlled expandable/contractible web loop may be provided in between two alternately engaged transfer stations, for alternately transferring batches of page print images onto opposite sides of the web in the proper sequence and positions, with interruption of the web feeding in the web segments in those areas. This is desirably coordinated with skipping and compensating for the unimaged belt seam areas to avoid creating blank paper areas between any images on the web which would otherwise have to be cut off and wasted.

15 Claims, 4 Drawing Sheets

Figure 1:
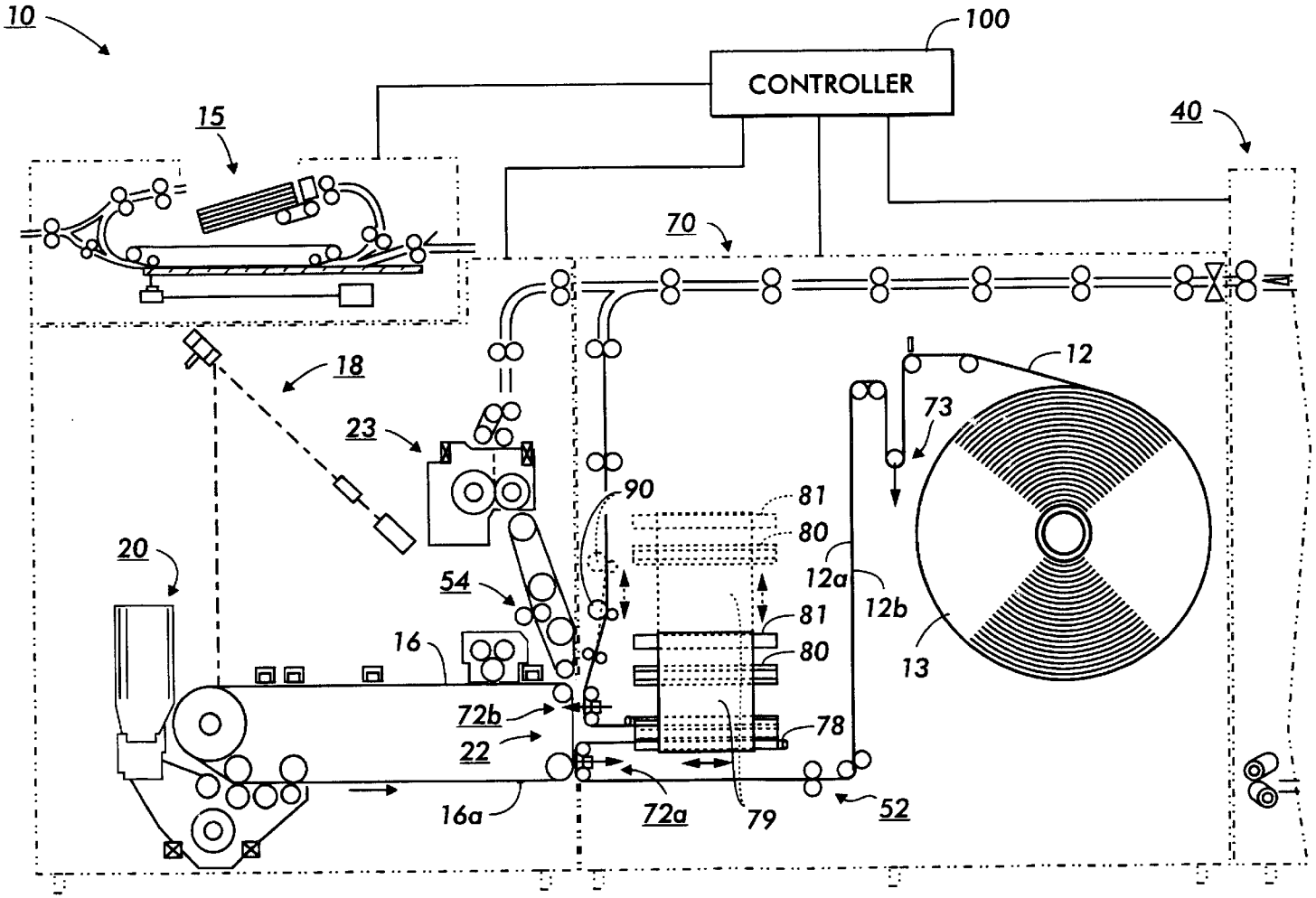

CONTINUOUS IMAGING OF A CONTINUOUS WEB SUBSTRATE WITH A SINGLE PRINT ENGINE WITH A PHOTORECEPTOR BELT SEAM

Cross-reference is made to other contemporaneously filed and commonly assigned applications by the same inventor also disclosing duplex web printing systems with single print engines; U.S. application Ser. Nos. 08/941,622; 08/941,848; 08/941,133; and 08/940,917; with respective Attorney Docket Nos. D/96729; D/96730; D/96731; and D/96733.

The invention relates to improvements in printing systems providing for printing, especially xerographic printing, onto a continuous web substrate, as opposed to cut sheet substrates, with a single print engine, as opposed to printing systems requiring separate, dual, or multiple print engines. In particular, the disclosed embodiments disclose improvements in printing one side (simplex printing) or both sides (duplex printing) of a continuous web printing substrate efficiently utilizing a single print engine, which print engine may even be an otherwise conventional or existing xerographic cut sheet printer, having an endless photoreceptor belt made with a seam area which cannot be imaged.

Higher speed cut sheet xerographic print engines typically have belt type photoreceptors with seams where two ends of the belt material were fastened together to make an endless surface belt. Such seams prevent uninterrupted continuous imaging of the photoreceptor. Since efficient continuous web paper substrate printing (without generating large amounts of scrap paper from unimaged areas of the web that have to be cut out) requires printing the web with directly abutting sequential page print images, this problem has heretofore inhibited the use of such high speed belt type photoreceptor print engines for continuous web printing.

The disclosed embodiments may desirably employ known existing or conventional high speed cut sheet electronic printers (print engines) with seamed belts with very little structural modification of those printers. Duplex web printing may even be provided by selectable modular integration with a disclosed or other duplex web feeding module which can be moved to any desired location, or removed to allow cut sheet printing with the same printer, instead of requiring large, expensive, specially built integral web printing machines capable only of web printing.

The images for both sides of the web may be imaged sequentially on a conventional phtoreceptor or other imaging surface of a conventional width (that need not be wider than the widest single image), because the two illustrated web image transfer stations for the two sides of the web may be aligned with one another in the direction of movement of the imaging surface, not side by side. That is, the illustrated duplex web transfer system not only inverts and returns the continuous web in a loop back to the same general transfer area, it does so without requiring any lateral shift in position of the web between its first and second side transfer positions.

By way of background, in reproduction apparatus such as xerographic and other copiers, printers or multifunction machines, it is increasingly important to provide faster yet more reliable and more automatic handling of the physical image bearing substrate. High speed printing of individualized document images by xerographic, ionographic, ink jet or other copiers, printers or other reproduction apparatus (encompassed by the word printers here) has become increasingly important and increasingly demanding in terms of quality, reliability, and other features. Enhanced printing features can include the ability to do either full color or black and white printing, and printing onto one or both sides of the image substrate, i.e., simplex or duplex printing.

As is well known in the art, duplex printing onto pre-cut paper sheet substrates, as in conventional xerographic copiers or printers, is much easier than duplex web printing. In cut-sheet printing machines duplexing is typically done by generating and transferring visible images to one side of the copy sheets, then inverting those copy sheets before or in a duplex loop path (which may be either an endless path, or include a duplex intermediate storage or buffer tray), and then returning those inverted sheets in the duplex loop path back to the same or another transfer station for transferring a second side image to the second side of the sheets before they exit the printing machine.

However, it is also well known that, especially for very high speed or high volume copying or printing, it is desirable to use a continuous web print substrate in some applications. In web feeding, instead of feeding pre-cut sheets to be printed, the image substrate material is typically fed from large, heavy rolls of paper, which can be from paper mill rolls, and thus provided at a lower cost per printed page than pre-cut sheets. Each such roll provides a very large (very long) supply of paper printing substrate in a defined width. (Fan-fold or computer form web substrate can also be used in some limited printing applications, e.g. where edge sprocket hole feeding is desired.) Typically, with web roll feeding, the web is fed off the roll and through the xerographic or other print engine to be printed and thereafter cut in a chopper and/or slitter at or after the printer output to form the desired copy sheets. Alternatively, the printed web output be rewound onto an output roll (uncut) for further processing off line. Web paper has feeding and printing reliability and plural image registration advantages as compared to conventional precut sheets. That is, in addition to the cost advantages, web feeding can also have advantages in feeding reliability, i.e., lower misfeed and jam rates within the printer as compared to high speed feeding of precut sheets through a printing apparatus. A further advantage is that web feeding from large rolls requires less downtime for paper loading. For example, it is not uncommon for a system printing onto web paper from a 5 foot diameter supply roll to print continuously for an entire shift without requiring any operator action, compared to the need for an operator to re-load cut sheet feeders 2 to 3 times per hour on a typical cut sheet feeder system of equivalent speed. Continuous web printing also provides greater productivity for the same printer processing speed and corresponding paper path velocity through the printer, since with web printing the images can be printed in direct sequence, with no pitch space skips between images as is required between each sheet for cut sheet printing. Continuous web xerographic copying was pioneered by Xerox (then Haloid) Corp. with the 1955 introduced "Copyflo"® printer.

However, continuous web feeding and printing typically requires a larger printing engine, taking more floor space, and special transport and loading assistance for the heavy paper rolls. Also, the web has to be threaded into the machine from the roll, and/or may need to be spliced onto the end of the prior exhausted paper roll.

Web feeding is more suitable where the same substrate can be used for all or most of long runs of single sheet documents, or multi-page multiple print jobs in a printing run, all to be printed on the same substrate media. Quickly or easily changing between substrates is much more difficult with a web fed machine than a cut sheet machine. In a cut sheet machine different sheets of different sizes, weights, colors, pre-prints, holes, etc. can be loaded into different paper feeding drawers, and easily changed or substituted. The printer can automatically feed from any selected paper feed drawer or tray at any time to print intermixed sheet print jobs. In contrast, roll fed web machines typically require stoppage and re-threading of the web through the machine to change the web substrate, and some wastage in doing so.

However, in either web fed or cut sheet machines is also possible to use interposers or inserters downstream of the printing apparatus to insert preprinted sheets of different substrates, characteristics or dimensions into the printing job stream for intermixed substrate jobs. Examples of U.S. patents showing exemplary interposer modules are in, and cited in, U.S. Pat. No. 5,489,969. Such interposer modules can also include auxiliary external paper feed trays for feeding cut sheet image substrates back upstream into the print engine.

It is well known in general that interposers, sheet feeders, finishers, print engines and other components of printing systems can be add-on, interchangeable, or substitutable modules. Such modular sub-systems or components can be self-standing and mobile on wheels or tracks. Some examples of docking systems for print engines operatively connecting with independent sheet handling modules are disclosed in Xerox Corp. U.S. Pat. Nos. 5,553,843 and 5,326,093.

It is also know that the printer controller may desirably be automatically partially reprogrammed for different printing sequencing in general by or in accordance with the particular module attached to the printer, as disclosed in allowed Xerox Corp. U.S. Pat. No. 5,629,775 by Dale Platterter, et al., filed Jul. 27, 1994 as application Ser. No. 08/289,978 (D/93465); and pending Xerox Corp. U.S. application Ser. No. 08/846,191 (D/97166) filed Apr. 28, 1997, by David K. Young. Magnetic or other sources of a module docking signal are also taught in Xerox Corp. U.S. Pat. No. 5,138,373 issued Aug. 11, 1992.

It is also known to feed cut sheet substrates into a paper tray or other input of a regular cut sheet type printer or copier by automatically feeding and pre-cutting sheets from a paper roll feeding and cutting module operatively connected therewith. However, that does not provide the reliability and low jam rates of a printer in which high speed printing is done on an uncut or continuous web running through the printer and the sheets are chopped or cut into separate pages later, at the output of or after the printing operations. Also, such roll-cut sheets may have curl problems affecting their reliability in a conventional cut-sheet printer designed for reams of flat paper stock.

Roll feeding and printing systems can also be utilized for "two up" or "four up" (duplex signature) printing, by using wide web input of a dual page width and printing dual page images in side by side pairs on one or both sides, if the expense and space of a printing engine of that printing width can be justified.

However, another significant problem with web printing is that to do duplex (two-sided) printing on continuous web substrates is a much more difficult problem than for cut sheet printing machines. One solution has been to provide plural opposing print engines for respectively printing the opposing sides of the web, as disclosed for example in Xerox Corp. U.S. Pat. No. 3,940,210 issued Feb. 24, 1976 to James M. Donohue (with a programmable electronic controller), allowed U.S. application Ser. No. 08/624,280 filed Mar. 29, 1996, by Paul F. Morgan, now U.S. Pat. No. 5,701,565; or U.S. Pat. No. 5,455,668 by Jan J. I. De Bock, et al. Another example of dual xerographic color engines for duplex printing on web material is shown in EP 0 742 497 A1 published Nov. 13, 1996 to Jan Van den Bogaert (Agfa-Gevaert). However, these plural print engine web printing duplex systems require a correspondingly plural increase in size, cost, complexity and maintenance. It may be readily seen from these and other art examples that using two entire color printing engines to print both sides of a continuous web requires a large amount of floor space and the coordination of at least two separate complex and expensive printing systems rather than one.

As noted, adding full color capability adds considerably to the disadvantages of a dual or plural engine duplex web printing system, and makes a single printing engine duplex system (more like that for duplex cut sheet machines) even more desirable.

Thus, while duplex printing is known for roll or fanfold web printing, it is much more difficult, expensive, and space-consuming, especially for color printing, than duplex printing of precut sheets. However, customer requirements such as for booklet or signatures (4 up) printing, and/or for economic and environmental savings of paper and postage, require duplex rather than simplex printing.

Some examples of modern full color cut sheet xerographic printing systems, with a photoreceptor belt and plural image development stations, which may be referred to for further details in connection with the enclosed embodiments, include Xerox Corporation U.S. Pat. No. 5,537,190 issued Jul. 16, 1996 to Folkins, et al; U.S. Pat. No. 5,508,789 issued Apr. 16, 1996 to Castelli, et al; U.S. Pat. No. 5,160,946 issued Nov. 3, 1992 to Hwang; and other references cited therein. Since the systems disclosed herein are not limited to any particular color printing engine or system, as long as it is compatible with the other features claimed, it will be appreciated that there is no need to describe these or other known or conventional xerographic color printing engines in any detail in this application.

It will be appreciated that known intermediate web transfer systems can be employed in xerographic or other printing, in which the images are formed on one or several (for color) photoreceptors and then initially transferred to an intermediate belt before a second and final transfer from that intermediate belt to the paper web 12. Some examples are in Xerox Corp. U.S. Pat. Nos. 5,508,789 and 5,631,686 and other art cited therein. The terms imaging member or photoreceptor in the claims here may thus encompass such an intermediate belt unless otherwise limited.

Art of particular interest here, in illustrating the possibility and difficulty of providing the capability for both simplex and duplex printing with a single xerographic print engine for a continuous web (here fan-fold) paper substrate, with inversion of the moving web for the second side printing, is U.S. Pat. No. 5,568,245 issued Oct. 22, 1996 to Otto Ferber, et al (Siemens Nixdorf) based on EPO App. No. 94112973, with other apparently related if slightly different published equivalent disclosures in German, including EP 771437-A1 (WO 9602872-A1—PCT/DC 95/00635) (note especially FIG. 1), and EP 699315-A1 (WO 9427193-A1).

Although said U.S. Pat. No. 5,568,245 shows and describes a drum photoreceptor, it also mentions in Col. 5, last paragraph, that "a web-shaped intermediate carrier, for example, an OPC band, can also be employed".

In said U.S. Pat. No. 5,568,245, the web turnover means of FIG. 3 and Cols. 8–10 in particular is of particular interest. It includes, as described therein, two sequential low friction web deflectors, rods, or drums, at approximately 45° relative to the paper running direction. This turnover means turns the recording medium over by 180° and also displaces it laterally by the width of one recording medium. These web deflectors may be hollow rods with integral air and wear resistant polished glide surfaces for low friction with the web recording medium. Further described in said U.S. Pat. No. 5,568,245 is that this turnover means has a first reverser following the first oblique deflector in the conveying direction for returning the recording medium toward a second reverser approximately parallel to the first reverser for a second reversal of the recording medium before the web enters the second oblique deflector. (It is noted that it seems easier to understand this web inversion system 28 from the FIG. 1 paper path drawing of the equivalent WO 9602872 A1 (PCT/DE 95/00635) than said U.S. Pat. No. 5,568,245.) In either case, it may be seen that there is a very long paper path of the web between its first and second side printing in that prior art system, and that the second side is printed in a separate web path parallel to the first side printing web path. That system, however, requires a double width photoreceptor drum and xerographic system since the second side image transfer station is laterally spaced along the axis of the photoreceptor from the first transfer station for the first side image.

It will be noted that the use of a 45° web baffle or deflector around which a continuous web is wrapped to turn the web over is well-known per se. It is illustrated in Xerox Corporation U.S. Pat. No. 3,548,783 issued Dec. 22, 1970 to Lowell W. Knapp for inverting the web between two xerographic print engines to provide duplex printing on the web. Duplex web printing using a series of three such web deflectors in series, so that the web enters and leaves the inverter in the same movement direction, is shown and described in the Xerox Disclosure Journal publication Vol. 9, No. 3, May/June, 1984, pages 201–203.

A particular difficulty, addressed here, in printing from an endless belt type photoreceptor printing engine onto a continuous web substrate is the fact that belt type photoreceptors, as compared to solid drum type photoreceptors, typically have a belt seam where the two ends of the belt are fastened to one another to form a continuous loop. Typically it is either impossible or undesirable to form images overlying this belt seam. Thus, in cut sheet machines, either the printing is skipped in the belt seam area, or the image positions on the belt are skipped or re-arranged where possible (depending upon their size) so as not to image overlying the belt seam area. However, these approaches often result in an asynchronous or irregularly spaced image production. That can present a significant problem to the transfer of those images to a mating continuous web image substrate which, unlike a copy sheet, cannot easily be asynchronously or intermittently fed to the image transfer station at which the image is transferred from the photoreceptor belt to the web substrate. That is because the substrate web is a continuum, and also because it is difficult or impractical to rapidly start and stop paper webs in a printing system they are running through at high speeds because of the danger of web tearing, slippage, or misregistration, and/or the large moment and mass of the paper roll. Buffer loops and dancers rolls are known for web input speed variations buffering.

Specific features and advantages of the embodiments disclosed herein include a web printing system for printing page images in continuous abutting relationship on a continuous web print substrate by transferring said page images to said continuous web print substrate from an endless surface imaging member while both are moving in a defined direction of movement at a process movement speed, wherein said endless surface imaging member has a minor seam area, said web printing system automatically provides a minor unimaged portion extending along said endless surface imaging member to encompass said seam area, with a defined beginning and end in said defined direction of movement, which unimaged portion is not imaged with said page images, said endless surface imaging member has a major portion which is imagable by said web printing system with plural said page images in continuous directly abutting relationship in said defined direction of movement; and said web printing system further includes at least one image transfer and web feed control system which automatically engages and disengages a minor portion of said continuous web from said endless surface imaging member with said continuous web for transferring said page images to said continuous web in said continuous abutting relationship.

Further specific features and advantages disclosed herein, individually or in combination, include those wherein said image transfer and web feed control system automatically disengages said minor portion of said continuous web from said endless surface imaging member at said beginning of said unimaged portion of said endless surface imaging member, then automatically reverses said minor portion of said continuous web by a short distance, and then automatically accelerates said minor portion of said continuous web to substantially match said process movement speed of said endless surface imaging member in said defined movement direction, and then automatically re-engages said minor portion of said continuous web with said endless surface imaging member at said end of said unimaged portion of said endless surface imaging member; and/or wherein there are two said image transfer and web feed control systems, for printing opposite sides of said continuous web for duplex web printing; and/or wherein said web printing system is alternately adapted for simplex printing of only one side of said continuous web, wherein said web printing system is adapted to form said page images as simplex page images on said major portion of said endless surface imaging member in both forward and reverse serial page order, wherein for simplex printing of said continuous web only a selected one of said two image transfer and web feed control systems is engaged with said endless surface imaging member for transferring said simplex page images to only one side of said continuous web, wherein one of said two image transfer and web feed control systems engages said endless surface imaging member with the first side of said continuous web when said page images are in said forward serial page order, and wherein the other of said two image transfer and web feed control systems engages said endless surface imaging member with the second side of said continuous web when said page images are in said reverse serial page order, to transfer said simplex page images from said endless surface imaging member to said continuous web in a desired output orientation; and/or further including a duplex web feeding and inverting system providing inversion of said continuous web and an expanding and contracting length of web loop in said continuous web in between said two image transfer and web feed control systems for temporarily retaining a batch of plural said page images which have been transferred to one side of said continuous web, and wherein said web printing system generates controlled alternating sequences of plural said page images on said endless surface imaging member for opposite sides of said continuous web in sequential batches of sequential plural images for one side of said continuous web print substrate respectively alternating with plural said page images for said second side of said continuous web, respectively before and after said seam area, and coordinated with said expanding and contracting length web loop; and/or wherein said sequential batches of plural said page images for one side of said continuous web are temporarily retained in said expanding and contracting length web loop and correspond in number to the number of said page images on said endless surface imaging member in one revolution of said endless surface imaging member; and/or wherein said continuous web is continually fed by a continuous web print substrate supply system, and wherein said continuous web print substrate supply system and said image transfer and web feed control system are both an independent module undockable from said web printing system; and/or wherein said image transfer and web feed control system additionally automatically repositions said continuous web to correct for web registration errors while said continuous web is so disengaged from said endless surface imaging member at said seam area; and/or in a web printing system for printing one or both of the first and second sides of a continuous web print substrate with a print engine having a revolving endless surface imaging member on which page print images are generated, said revolving endless surface imaging member having a defined direction of movement, by transferring said page print images from said endless surface imaging member of said print engine to said continuous web print substrate in a continuous sequence of directly adjacent said page print images, while said endless surface imaging member and said continuous web print substrate are moving in the same direction at substantially the same speed, the improvement comprising; said endless surface imaging member comprising a photoreceptor belt with a belt seam area on which a page print image cannot be generated, said print engine providing an unimaged gap in said generated page images on said photoreceptor belt in said defined direction of movement for said belt seam area; at least one image transfer station for image transfers of said page print images from said endless surface imaging member to at least one side of said continuous web print substrate, said image transfer station normally providing engagement of said continuous web print substrate with said endless surface imaging member, said image transfer station further providing automatic intermittent disengagement of said continuous web print substrate from said endless surface imaging member for at least said unimaged gap, and a continuous web print substrate supply system providing controlled feeding of said continuous web print substrate to said print engine endless surface imaging member at said image transfer station, said continuous web print substrate supply system and said image transfer station cooperating to prevent said unimaged gap in said generated page images on said photoreceptor belt from transferring to said continuous web print substrate, to provide said continuous sequence of directly adjacent said page print images on said continuous web print substrate; and/or in which said continuous web print substrate supply system and said image transfer station cooperate to prevent said unimaged gap in said generated page print images on said photoreceptor belt from transferring to said continuous web print substrate by said automatic intermittent disengagement of said continuous web print substrate from said endless surface imaging member at said belt seam area, and intermittently interrupting the movement of said continuous web print substrate at said transfer station with said continuous web print substrate supply system during said disengagement; and/or wherein there are two said image transfer stations, comprising first and second image transfer stations, for alternately respectively transferring said page print images directly from said photoreceptor belt to the first and second sides of said continuous web print substrate, and said continuous web print substrate supply system has a duplex web feeding and inverting system for feeding said continuous web print substrate into image transfer engagement with said photoreceptor belt twice, in said first and second image transfer stations respectively, with inversion of said continuous web print substrate between said first and second image transfer stations, and said first image transfer station transfers said page print images to said first side of said continuous web print substrate upstream of said belt seam area, then said first image transfer station automatically disengages said continuous web print substrate from said photoreceptor belt before said belt seam area passes said first image transfer station, and then said second image transfer station engages said continuous web print substrate to transfer said page print images to said second side of said continuous web print substrate after said belt seam area passes said second image transfer station; and/or wherein said image transfer station automatically lifts the portion of said continuous web at said image transfer station out of contact with said photoreceptor as said photoreceptor belt seam passes by said transfer station, and said continuous web print substrate supply system automatically stops said continuous web motion at said transfer station, partially reverses said web, and re-accelerates said web to re-engage said photoreceptor at said speed thereof with the trail edge of the last page print image transferred to said web prior to said belt seam abutting the lead edge of the first page print image transferred to said web after said belt seam; and/or wherein said first image transfer station stops transferring said page print images to said first side of said continuous web at a time coincident with said photoreceptor belt seam approaching said first transfer station, and said second image transfer station starts transferring said page print images to said second side of said web at a time coincident with said photoreceptor seam passing said second image transfer station.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software and computer arts. Alternatively, the disclosed control system or method may be implemented partially or fully in hardware, using standard logic circuits or single chip VLSI designs.

It is well known that the control of document and copy sheet handling systems may be accomplished by conventionally actuating them with signals from a microprocessor controller directly or indirectly in response to simple programmed commands, and/or from selected actuation or non-actuation of conventional switch inputs such as switches selecting the number of copies to be made in that job or run, selecting simplex or duplex copying, selecting a copy sheet supply tray, etc. The resultant controller signals may conventionally actuate various conventional electrical solenoid or cam-controlled sheet deflector fingers, motors or clutches, or other components, in programmed steps or sequences. Conventional sheet path sensors or switches connected to the controller may be utilized for sensing, counting, and timing the positions of sheets in the sheet paths of the reproduction apparatus, and thereby also controlling the operation of sheet feeders and inverters, etc., as is well known in the art.

In the description herein the terms "web", and "sheet", respectively refer to a flimsy physical elongate web, or cut sheet, of paper, plastic, or other suitable physical substrate for printing images thereon. A "job" or "print job" is normally one or more sets of related sheets, usually a collated copy set copied from a set of original document sheets or electronic document page images, from a particular user, or otherwise related.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Figure 2:
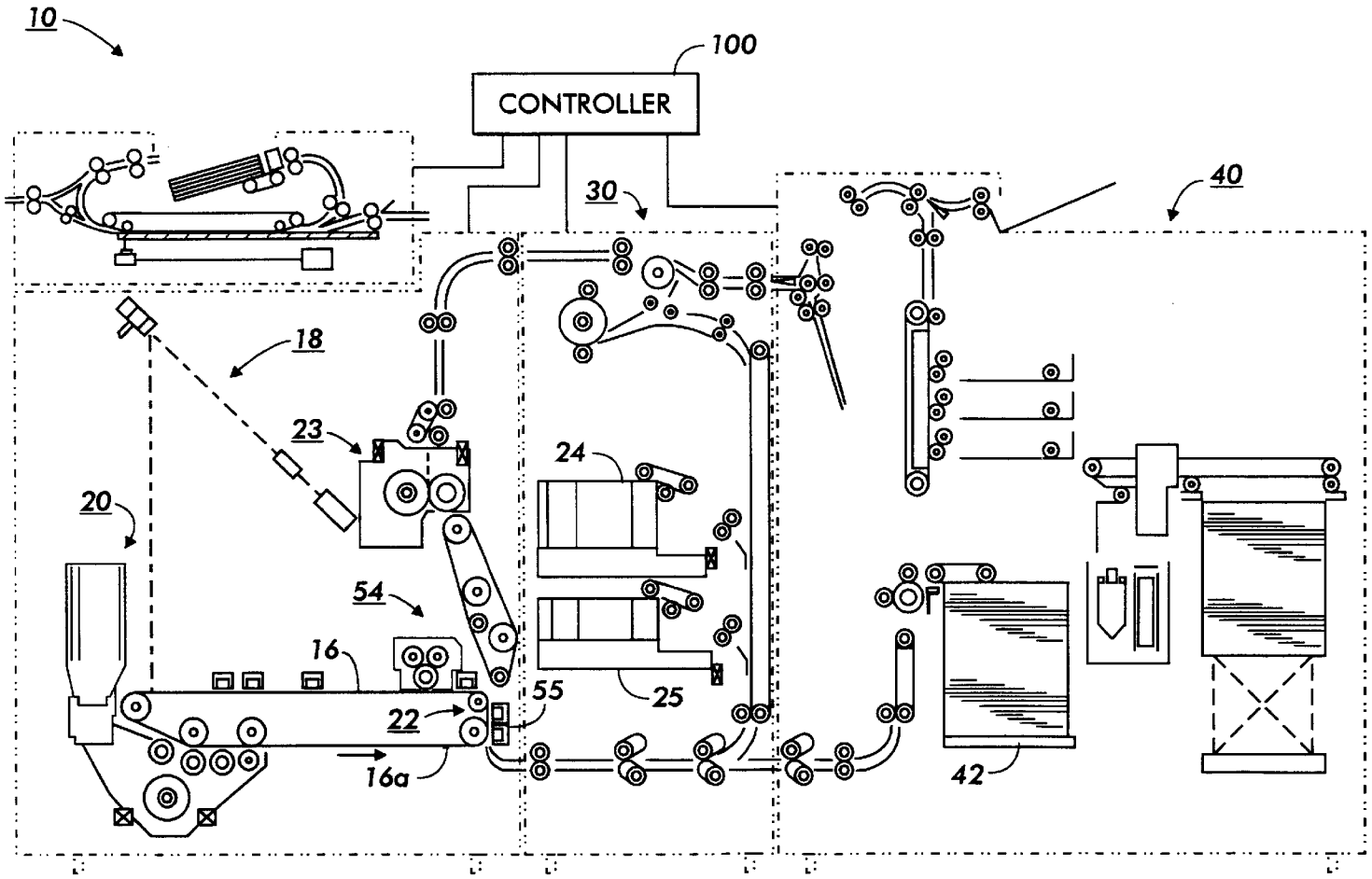
Figure 3:
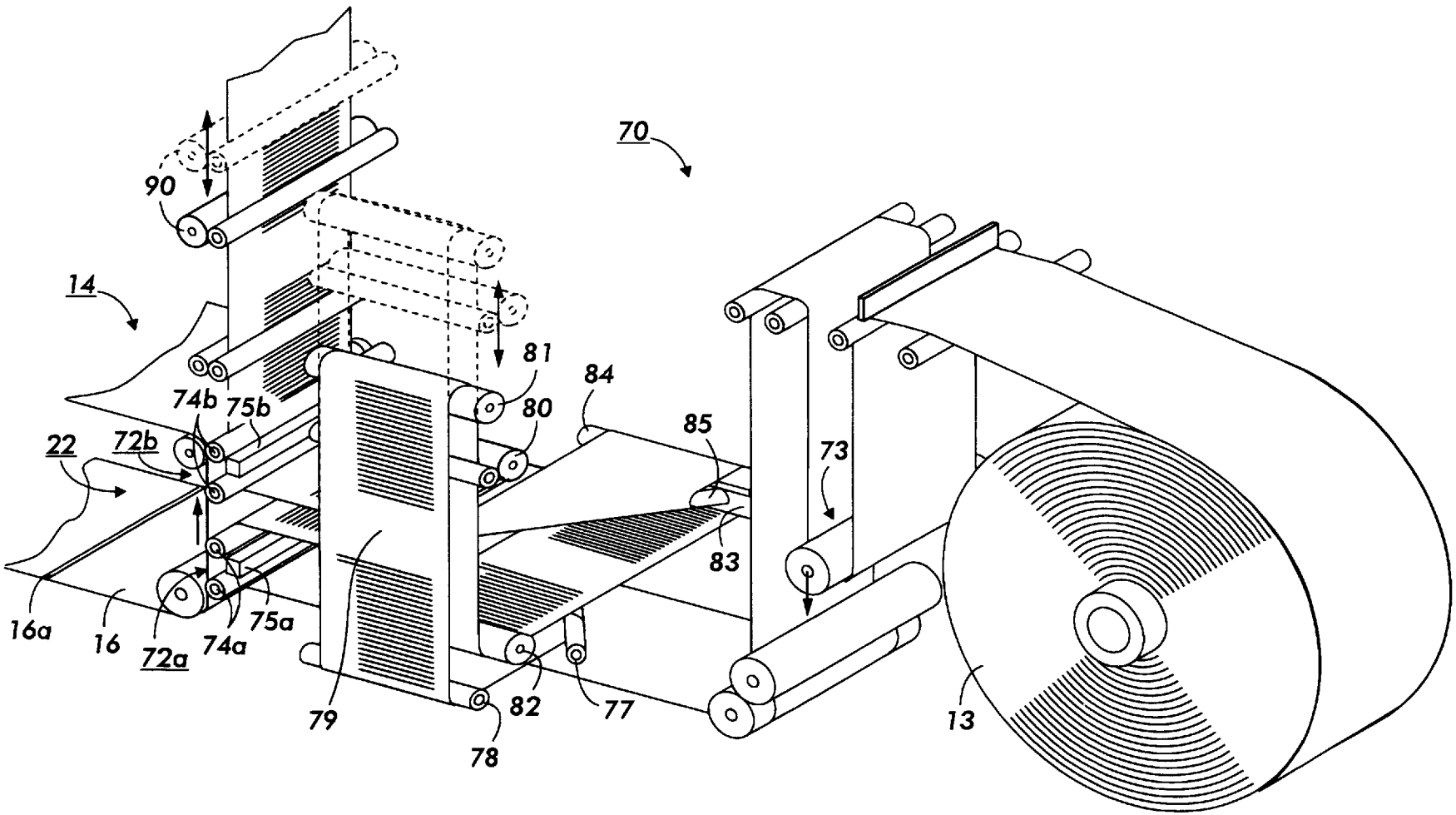
Figure 4:
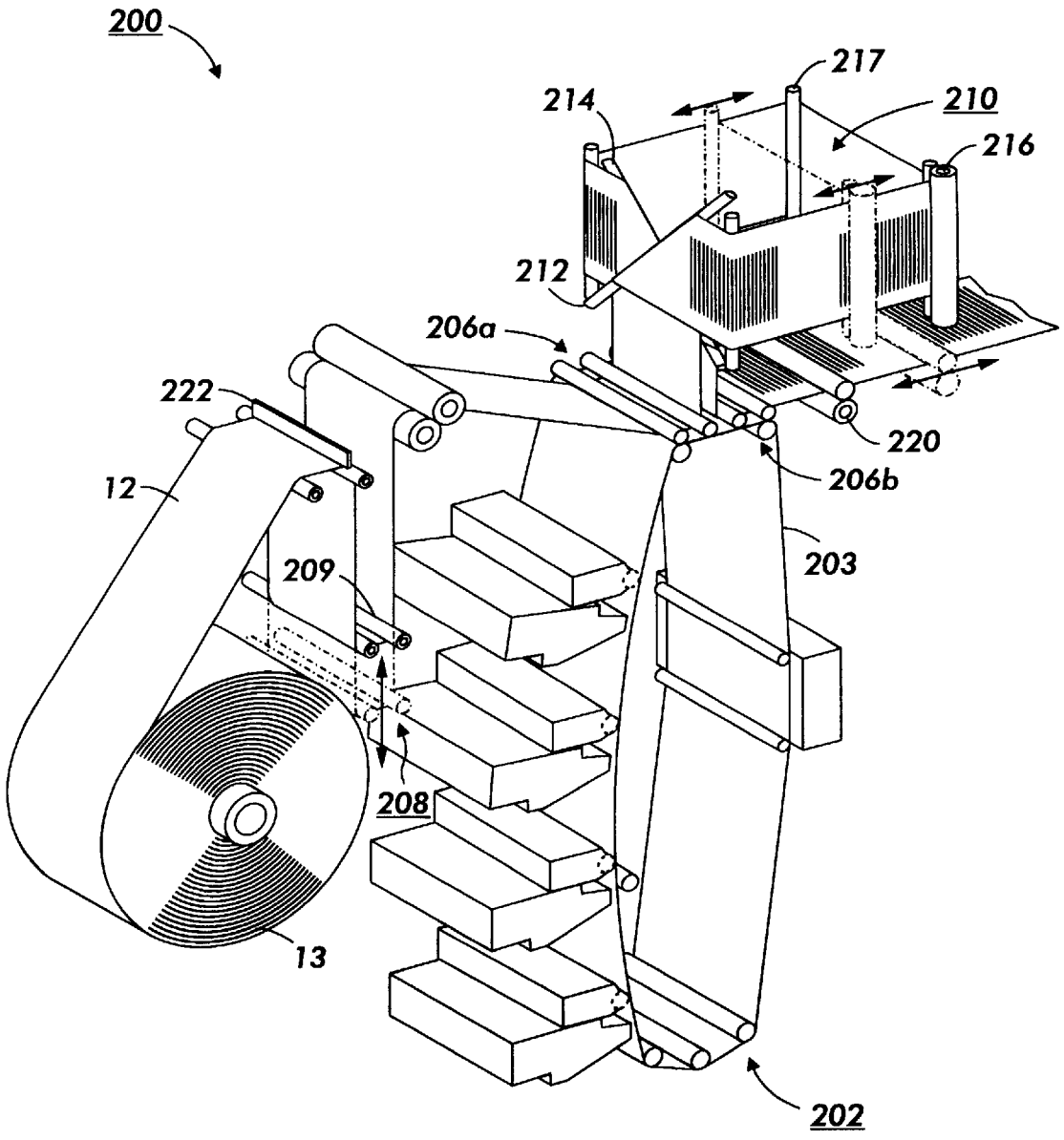

Various of the above-noted and further features and advantages will be apparent from the specific apparatus and its operation described in the examples below, including the drawing figures (approximately to scale) wherein:

FIG. 1 is a schematic side view of one example of a dual mode (cut sheet or continuous web) printing system with a single engine xerographic printer, here an otherwise unmodified conventional cut sheet printer, combined by docking with an exemplary duplex continuous web substrate supply module for printing onto a continuous web substrate fed therefrom to the normal cut sheet transfer area of the printer, as will be described, plus an integrated exemplary finisher module;

FIG. 2 is similar to FIG. 1 but showing the interchange of a cut sheet feeder and/or interposer module replacing the FIG. 1 exemplary continuous web duplex module;

FIG. 3 is an enlarged frontal perspective schematic view of the web paper path of the duplex continuous web module embodiment of FIG. 1 plus the mating partial portion of the single xerographic printing engine embodiment of FIG. 1, showing the two sequential image transfer stations for image transfers to both sides of the web fed from said duplex web module; and FIG. 4 shows a an enlarged frontal perspective schematic view of the web paper path and transfer stations of another duplex continuous web substrate supply and transfer module embodiment, with many similar elements to those shown in the module of FIGS. 1 and 3, but modified to be compatible with a print engine with a top transfer position (instead of a side transfer position).

Shown in FIGS. 1 and 3 is one example or embodiment of a duplex web printing system 10 for printing page images onto both sides of a continuous web substrate 12. This system may, if desired, be modular, so that, as in FIG. 2, the duplex web printing may be removed or replaced for conventional printing with the same print engine onto conventional cut sheet substrates. In the embodiment of FIGS. 1 and 3, the web 12 may be duplex printed on both of its sides 12*a* and 12*b*. The roll 13 from which the continous web 12 is being fed to be printed in the printing system 10, and various other conventional or known components, may be common to different modes and modules, and need not be fully illustrated or discussed here.

It will be appreciated that the duplex web embodiments herein can alternatively also do simplex printing, i.e., printing only one side of the web. This may be done by only engaging and using one transfer station and one fuser, continuously.

As will be further discussed, if there is a seam in the photoreceptor, seam skipping to avoid paper waste can be provided by briefly removing the web from the photoreceptor in the transfer station, backing up (reversing) the web there by the unimaged area distance that was skipped for the seam, and then re-engaging the web with the photoreceptor with the web positioned so that the next image prints directly after the prior image. This may be done each time the unimaged photoreceptor seam area passes under the transfer station, so that the printed web has continuous images with no blank paper sections between images that would need to be cut off and discarded.

The printing system 10 here shows a single exemplary well known conventional xerographic printing engine 14 which is normally only capable of cut sheet printing. Various such printers can be used in the subject printing system 10. The illustrated printer or copier 14 is the Xerox Corporation "DocuTech"® printer. That type of cut sheet printer or copier example is shown and described in numerous Xerox Corporation patents, such as U.S. Pat. Nos. 5,095,342 and 5,489,969, and thus need not be described in detail herein. In this exemplary print engine 14 a conventional single endless belt photoreceptor 16 is being conventionally sequentially latent imaged with page images, such as by a ROS laser printing imaging system 18, or an LED bar, or the like. The latent images are developed with visible image developer material by a development system 20, which may include plural development units for plural colors. At an image transfer station area or position 22 the developed images are normally transferred from the photoreceptor 16 to one side of the image substrate. In this particular printer embodiment the transfer station area 22 is located near the downstream side of the printer 14, where the photoreceptor belt 16 is moving vertically upward. Within the xerographic print engine 14 a conventional fusing system 23 is provided in which the transferred developed images are fused to the cut sheets image substrates when the system 10 is in a cut sheet printing mode. Conventionally, as in the alternative mode of FIG. 2, that image substrate is a cut sheet fed to the transfer station 22 from a selected internal cut sheet feed tray of the printer 14, or, as shown, from cut sheet feed trays such as such as 24 or 25 in an integral cut sheet module 30 as shown in FIG. 2. Optionally, another source of cut sheet for printer 14 substrate input can be a high capacity sheet feeder 42 in a conventional finisher and output sets stacker module 40. Other external auxiliary cut sheet feed trays, such as sheet feed trays in an interposer or other module may be used (note the descriptions thereof cited above). Note that the interchangeable cut sheet module 30 of FIG. 2 is optional, and is not essential to the system 10. As shown in FIG. 2, the printer 14, the cut sheet module 30 and the finisher module 40 may be conventionally interconnected or docked together in series in that order to form an interconnected cut sheet supply, printing and on-line processing paper path system. Similarly, as shown in FIG. 1, it is the printer 14, the (interchanged) web feed module 70 and the finisher module 40 that form an integral paper path system.

The printer 14 may be conventional controlled by a conventional programmable controller 100, as described above. As per the above-cited art, the controller 100 here may desirably be automatically partially reprogrammed by or in accordance with the particular module attached to the printer 14. In particular here, reprogramming the page image spacing and/or sequence on the photoreceptor between that appropriate for image transfers to cut sheet or a continuous web.

In this system 10, in FIGS. 1 and 3, the images to be printed may be sequentially transferred to appropriate page order opposing side areas of the continuous web 12 by the same (normally cut sheet) print engine 14. As shown, that may be accomplished by the connecting continuous web module 70, or the like, for printing with this print engine 14 onto the continuous web substrate 12 fed from the module 70, here to the normal transfer station 22 area of the printer 14. The web 12 is then removed from the transfer area for downstream fusing and cutting into page image sheets. In the web printing system 10 here, the web module 70 here preferably has its own internal imaged web fusing systems and conventional output web chopper.

If the unit 70 is modular, the module interchange can be simply accomplished with simple conventional docking latches and wiring harness interconnect plugs as the independently wheeled unit is wheeled together with the print engine 14. Various known docking systems can be used for selectively operatively docking and undocking said web printing supply module with said sheet print engine. As noted above, some further examples of module docking systems for print engines and operatively connecting independent sheet handling modules are disclosed in Xerox Corp. U.S. Pat. Nos. 5,553,843 and 5,326,093.

It is important to note that the only mechanical or shared paper path portion or connection needed of the printer 14 for the module 70 is the small area of its transfer station 22. Since that is at one side of this printer 14 it is easily accessible by a docking aperture shown in that side wall of the printer 14 into which the transfer station of the module projects when it is docked there. For the module 70, its two adjacent transfer stations 72*a* and 72*b* project into that same transfer area 22 when that duplex module 70 is docked with the print engine 14. However, the present system is not limited to printers with that particular side transfer station 22 location. The duplex module could then have a correspondingly different docking configuration. Note the embodiment 200 of FIG. 4.

Note that the web printing module 70 here in this example does not itself generate or print the page print images. Rather, it includes a system to feed an extended loop of the continuous web into the cut sheet print engine to the image transfer station area, and that printing is done by the same existing cut sheet print engine 14.

In the module 70, the web 12 conventionally is fed off of the roll 13 into a conventional dancer roll buffer loop system 73, for movement variations compensation. Two movable paired transfer rolls systems 74*a*, 74*b* are provided to move one side at a time of the web 12 into the printer 14 against the photoreceptor 16 in the transfer station 22 area whenever it is desired, or the appropriate time, to transfer a developed image to the web 12 in the correct sequence. The web 12 is transported by its web drive system in those image transfer areas at substantially the same velocity as the surface of the photoreceptor 16, which may continue to move normally. As is known in xerography, in the image transfer area, the web may be driven at the same speed as the photoreceptor by the electrostatic tacking of the paper to the photoreceptor. That can be assisted by slack or dancer loops in the web provided in the web transport or feeding path before and after transfer. Or, a constant slip system can be used in which the web is driven at approximately 0.25% or less faster or slower than the contacting photoreceptor surface. A part of the web drive may be provided by the driving of the nips of the illustrated roll fusers. However, additional conventional driven feed roller nips can be provided, not all of which need be illustrated here, for drawing clarity.

A conventional coratron or scoratron such as 75*a* and 75*b* may be mounted in the module 70 behind the web 12 intermediate the web transfer rolls system 74 for conventional corona charge toner transfer. Alternatively, the module 70 can provide a known biased transfer roll system.

By changing the imaging system 18 input, buffering and/or internal software to eliminate the normal interdocument or pitch gap required for cut sheet printing, continuous printing onto the web 12 can be provided from the same machine 14. This allows a higher printing rate (more pages per minute) than for cut sheets with no increase in process speed (photoreceptor velocity, etc.). That also means that the web transfer rolls system 54, 74 does not need to retract to remove the web from the photoreceptor between each page image. Images can be printed in direct immediate sequence along the web 12. Preferably, this software change occurs automatically upon and from the electrical interconnection of the module 70, or a docking switch signal therefrom, as in art cited above, identifying to the controller that that particular modular unit is connected for web printing versus cut sheet printing.

However, if, as is usually the case, the photoreceptor 16 is a seamed web belt, with a belt ends fastening seam such as 16*a*, it may be desirable for the web transfer rolls system 74 to briefly lift the web 12 away from the photoreceptor 16 for the passage of that unimaged belt seam area to avoid a wasted unprinted or blank space on the web every time that portion of the photoreceptor belt comes around through the transfer station (on every rotation of the photoreceptor belt). The web transfer rolls system 74 thus provides web loops, which may be coordinated with a temporary interruption in the downstream web feeding, so that, as that web loop is retracted and then expanded (as the web is removed from and then returned to engagement with the photoreceptor), the web 12 does not advance between its removal and return in that area, so that no unprinted area wastage need occur. The web may also or alternatively be effectively slightly rewound back to the end of the prior transferred image area in the web transfer loop. The next image can thus be printed onto the web 12 directly following the previous image thereon even though the photoreceptor 16 has a substantial gap between its images for the unimaged photoreceptor belt splice or seam area 16*a*.

In the module 70 there may be provided, in the web exit path therefrom, a conventional web chopper 76 coordinated with the known transferred image positions on the web to cut the web printed output into separate imaged cut sheets before the output, as is well known per se. Alternatively, the output of duplex printed web may be rolled back up and carried away for cutting and further processing elsewhere.

Here, the module 70 is preferably docked, at its side opposite from the printer 14 docking side, with the existing or conventional on-line finisher module 40 (normally docked directly with the printer 14 to receive its printed cut sheet output). Also, the module 70 here has its output at the same height at the cut sheet output of the printer 14. Thus, here the output of the web printing module 70 can be fed directly into the finisher 40, as shown, to be stacked, stapled, glued, bound or otherwise finished in job sets or books in the same manner, and using the same existing output/finishing hardware.

Turning now the further details of the duplex web printing module 70 of FIGS. 1 and 3, it may be seen that in this module 70 a web paper path system is provided for turning over (inverting) the web 12 after one side 12*a* has been imaged at the first side transfer station 72*a*, and fused in a first roll fuser 80, then returning the inverted web 12 in proper page sequence for its opposite, second, side 12*b* printing at a second, adjacent, transfer station 72*b*. Both transfer stations 72*a* and 72*b* fit into the approximate space and photoreceptor engagement area normally occupied by the cut sheet printing transfer station 22. Furthermore, a wider, dual image width, photoreceptor is not required here either. The two transfer stations 72*a* and 72*b* here for printing the two sides of the web 12, and the images to be transferred, are sequentially aligned in the direction of movement of the photoreceptor 16, not side-by-side transversely of the photoreceptor as in the above-cited U.S. Pat. No. 5,568,245.

The turnover and image position synchronization system web path illustrated in FIG. 3 includes, in sequence, following the return of the web back from the first imaging station 72*a*, a first forty-five degree or right angled web turnover bar 77 (see art cited above), a first ninety degree web turn roller 78 to turn the web vertically into a first or side one web expandable loop 79 formed by an outer, first, 180 degree web turn roller 81, then a first side moving roll fuser 80 (see their alternate position in phantom showing the loop 79 expansion); a second ninety degree web turn roller 82; an inner, second, 180 degree and elevation change pair of rollers 83, 84; and a second forty-five degree web turnover bar 85 directing the inverted web back for its second side 12*b* image transfer station 72*b*, from which the web moves up into a second side roll fuser 90. (This web path is further described below.)

As shown, the web may be pushed into and held in the first transfer station 72*a* against the photoreceptor for first side image transfer by a commonly movable pair of rollers 74*a* on each side of the transfer corona source 75*a* for that transfer. Likewise, after its above-described web inversion path, or other inversion system, such as a moebius strip inversion path, the web may be pushed into and temporarily held in the adjacent second transfer station 72*b*, just downsteam of 72*a*, for a second side image transfer by the movable pair of rollers 74*b* on each side of that transfer corona source 75*b*. In both, a web loop is formed thereby extending into and out of the print engine 14, and in and out of the duplex web printing substrate supply module 70.

Although the web fusing fuser rolls may be conventionally stationary, i.e., remaining in the same position, as an additional, optional, disclosed feature, the first and second side roll fusers 80 and 90 are also shown here in phantom alternate positions to illustrate that they may move up and down, if desired. That is, the fuser 80 can fuse continuously at half the web process speed, moving up and down as its web expansion loop 79 expands and contracts. The fuser 90 likewise may travel up with the web 12 to fuse at half speed when the web 12 is moving at its full speed and move down when the web 12 is stopped, even though there is no pitch space between images in efficient web printing. There is translation of the fuser roll nip in both directions along the web, from and back to an original position. With the illustrated web duplexing system, half of the time the portion or segment of the web in the fuser nip is stopped. It is while that segment of the web is stopped that the fuser roll translates back to its initial position at half speed, with the rolls still engaged, continuing to fuse the web all the way. That is, the fuser rolls never separate and continuously fuse images to the paper regardless of whether the paper is moving or stopped, and regardless of the direction the fuser translates. While the web is in motion, the fuser translates in the direction of the web movement at half the speed of the web. The fuser rolls of course always rotate in a reverse rotation to the direction of web movement. When the web stops, the translation direction of the fuser rolls changes, but the direction of rotation of the rolls does not change. I.e., the direction of rotation of the fuser rolls never changes and the rolls never separate. Only the direction of their translation changes. The time required to image one side of the web (i.e., the time the fuser rolls translate in the direction of web motion and the time that segment of web is in motion) equals the time required to image the other or second side of the web, which equals the time the fuser rolls translate backwards as well as the time the segment of the web remains stationary. Thus, the fuser rolls return to the start position, and the entire segment of the web is fused at the same relative speed, which is half the imaging speed. Neither fuser requires a variable rather than a fixed speed drive. Since these fusers are fusing only half the process speed for for duplex printing, they can be less power-demanding.

The disclosed duplex web printing system 10, with a single print engine 14 and web duplex system 70, (whether modular or integral) includes the following aspects or features. (Although the module 70 may also be used for simplex web printing, onto only one side of the web, the duplex printing mode is primarily described here.)

The endless web 12 path inside the print engine 14 includes two transfer stations 72*a* and 72*b* for the two sides 12*a* and 12*b* of the web, which contact the photoreceptor either at two separate transfer locations, as shown, or, alternatively, at the same location. Preferably, only one transfer station engages the photoreceptor belt at any one time. Accordingly, during operation normally one transfer station is engaged, and the other disengaged, from the photoreceptor. As noted, at the transfer positions, the web speed may match the photoreceptor speed, or slightly mismatch the photoreceptor speed by 0.01% to 0.025% for slip transfer.

Between the two transfer stations 72*a* and 72*b*, the web path in the module 70 inverts the web so that opposite sides of the web can be moved into contact with the photoreceptor (one side at each transfer station) for duplex imaging. As noted, there are several known methods of inverting webs per se, including 45 degree turn bars, moebius strip paths, and the like.

There are two types of known per se disclosed path expansions or expanding/contracting web loops in the disclosed single engine duplex web printing system; dancer loops, and paper buffer loops. Typically, dancer loops are employed to isolate speed sensitive segments of the web path from one another in order to provide local control of a portion of the web. A dancer loop enables another portion of the belt to temporarily lag behind that portion in web velocity without causing undue stress on the web.

In this disclosed single engine but duplex web printing system, since only one side image is transferred at a time, while the side one image is being transferred to side one of the paper web at the first transfer station 72*a*, the portion of the web at the second transfer station 72*b* is held stationary, and is not in contact with the photoreceptor. A variable size web buffer loop 79 formed by translatable roller 81 is provided as shown in the web (paper) path between the two transfer stations 72*a*, 72*b* to temporarily store a web segment with plural side one images. When a batch of such side one images is complete, the web motion at the first transfer station stops while that transfer station 72*a* is lifted out of contact with the photoreceptor 16. The second transfer station 72*b* is then moved into contact with the photoreceptor to transfer a corresponding number of side two images onto the back of the side one images previously transferred. At this time, the portion of the web at the first transfer station 72*a* is held stationary, and paper is supplied to the second transfer station 72*b* by advancing the completed side one images previously stored in the web buffer loop 79.

The printer 14 imaging input system and controller 100 previously have electronically separated the incoming print job electronic pages into batches of plural first and second (even and odd, or vice versa) pages to be imaged in that batch order on the photoreceptor in batches to match the above-described web buffer loop plural images capacity. (As to batch mode duplex electronic printing in general, see Xerox Corp. U.S. Pat. No. 4,918,490 issued Apr. 17, 1980 by this same inventor.)

An additional web buffer loop 73 is provided prior to the first transfer station here. Thus, when the web is being imaged at the second transfer station, and the portion of the web at the first transfer station is temporarily stopped, the massive paper supply roll 13 need not be stopped. The supply roll 13 may continue to unwind and supply paper, which is temporarily stored in this pre-side one buffer loop, to be depleted when the system begins to transfer side one pages again (the next batch of side one pages). With this arrangement, even when the system is running duplex images, the supply roll 13 can operate at a relatively steady speed which is half the speed required for simplex images. The main benefit of this additional (pre-side one) buffer loop, is substantially less power and precision required to drive the supply roll 13.

As discussed above, two fusers 80 and 90 are disclosed, one for each side of the web 12. As noted, there are at least two methods of operating the fusers with the disclosed architecture. In the first method the fuser is mounted in a fixed location and includes a nip separating mechanism. With this approach, each fuser operates half the time at full speed, and half the time with the rolls separated and the web at that position stationary. When not operating, the fuser nips are separated in order to prevent advancing the web. In the other, preferred, architecture, as illustrated, both fusers are mounted on a translating carriage within the buffer loops. With this architecture, both fusers operate continuously, at half speed, as further described above.

A series of known or conventional sensors, tickmarks and web speed control systems may employed along the web path to provide belt speed and position control for proper transfer and registration. Note that the action of lifting the web out of contact with the photoreceptor when switching from one side transfer to the other, and later re-engaging it, affords the opportunity for correcting for registration errors due to speed mismatches between the web and the photoreceptor.

The paper supply roll input feed system should be designed to accommodate connicity in the supply roll of up to 0.3 to 0.5 inches, and wobble of up to 0.5 inches. Web steering systems may be provided to achieve lateral edge registration requirements. As noted, the supply roll may be positively driven to advance paper at a rate of half the process speed (photoreceptor speed) for duplex imaging, and at full process speed for simplex operation. The supply roll drive may respond to position sensors on the downstream dancer loop by either speeding upor slowing down slightly to insure sufficient speed matching with the photoreceptor. The web from the roll 13 may be initially advanced over the top of a splicing platform located near the top of the web path to facilitate operator access for manual splicing operations. The second of the two rollers on the splicing platform may include a paper clamp to keep the web from slackening downstream from that roll when a new paper supply roll is being loaded and spliced.

The next downstream element here is a dancer loop 73 and a paper buffer loop. This enables continuous feeding of paper off the supply roll at half speed. While the paper is stopped downstream at the side one transfer station, the dancer loop 73 expands to accept paper coming off the supply roll 13 at half speed. When images are being transferred at the first transfer station, the dancer loop contracts as it supplies paper to the first transfer station at full speed while continuing to accept paper from the supply roll at half speed. The next element is a pair of rollers to steer the web to correct for the connicity and wobble in the supply roll, and insure acceptable edge registration of the web at the first transfer station.

The web then passes through the first transfer station. This subsystem includes appropriate corotron or biased roll image transfer components, as discussed. As described previously, both the first and second transfer stations are capable of engaging and disengaging from the photoreceptor surface. The upstream and downstream web drive nip rollers there control the speed of the paper to match the photoreceptor speeds at slip transfer rates while the transfer station is engaged, and hold the paper in position while the opposite side is being transferred at the other transfer station.

As previously descibed, with reference numbers, the web is then inverted through the first of two 45° turn bars, which also directs the paper in a perpendicular direction toward the front of the machine. Note that the unfused first side image is on the outside face of the web so that it does not contract the turn roller. The web then passes through a side one expansion loop assembly. This portion of the web path is composed of four elements; two 90 degree torn rolls, a 180° turn roll, and a vertical loop expansion control mechanism. The two 90° turn rolls orient the expansion loop into a vertical direction in order to reduce the floor space required. (These two rolls could be deleted and the expansion loop deployed horizontally at the expense of increased floor space.) The loop expands or contracts depending upon whether the first or second transfer station is engaged with the photoreceptor. Within this expansion loop assembly here is the side one fuser 80, mounted either permanently to operate intermittently at full speed (with intermittent nip separation) or mounted on the expansion portion of the loop to operate continuously at half speed, as discussed previously.

The web then negotiates a second steering roll assembly composed of a gimbaled 90° turn roll and a 90° steering roll. This assembly corrects web edge registration prior to side 2 transfer. This assembly could be identical to the side one steering rolls assembly previously described.

The web is then inverted and turned back toward the photoreceptor with a second 45° turning roll. At this point, the blank side of the paper web is oriented such that it will engage the photoreceptor at the side two transfer station, located just downstream of this turning roll.

Downstream of the side two transfer station is the side two fuser. The two options described for the side one fuser also apply to the side two fuser.

The last element in the paper path of the module 70 is preferably a paper cutter, and preferably associated with the cutter is a scrap storage bin or tray. At the beginning of each job, the blank paper in the web path, including that between the first and second transfer stations is advanced toward the output area as the first images are transferred to the web.

That is, as is known per se, the output web chopper or cutting system may include means for automatically cutting off and diverting unimaged (blank) paper portions of the web, such as the lead-in portion of the web first threaded into the web path before printing starts, or jam recovery sections. Here, it is additionally suggested that, where possible, these blank web portions be cut up into standard sheet sizes which are diverted and stacked into a scrap recovery storage tray, for use in other, cut sheet, printing systems.

FIG. 4 shows a module 200 with many similar elements of the web path to those described above and below in the module 70. This configuration modifies the module 70 architecture to be compatible with a print engine 202 with a photoreceptor 203 top transfer position 204 for the side one and side two web transfer stations 206*a*, 206*b*, instead of a side transfer position. The major differences are as follows: The pre-side one transfer station 206*a* dancer loop 208 is shown with the steering roll 209 assembly mounted on the traveling portion of that expansion loop. This configuration eliminates one roller assembly. The expansion loop 210 between the two transfer stations 206*a* and 206*b*, including the in and out 45 degree turn bars 212, 214 the translatable side one fuser 216, and the translating roller 217, holds the web 12 in a vertical plane. The web expansion loop 210 expansion is by translating outward motion of the fuser 216 and roller 217 in a horizontal direction, parallel to the output path of the paper web. The second side (side two) web fuser 220 may be horizontal and underneath the expansion loop 210 as shown. This architecture is compact, and saves floor space. A web clamp 222 and splicing station 224 is also schematically shown here in FIG. 4.

As in the other embodiment 70, in this embodiment 200 the images for both sides of the web may be imaged sequentially on a conventional phtoreceptor or intermediate transfer imaging surface that need not be wider than the widest images, because the two web image transfer stations are aligned with one another in the direction of movement of the imaging surface, not side by side. That is, the disclosed system not only inverts and returns the continuous web in a loop back to the same general area, it does so without requiring any lateral shift in position of the web between its first and second side transfer positions.

In architectures for using a single engine to print on both sides of a continuous web substrate, a system is needed for limiting or preventing web paper waste or scrap when the photoreceptor belt or other imaging surface has a seam which cannot be imaged over. This seam problem is discussed in the introduction of this application. Most high end xerographic engines have seamed photoreceptor belts. A web fed paper architecture with continuous transfer onto the web from such a seamed photoreceptor belt would generate considerable waste paper scrap from the unimaged area on each belt revolution. Typically, images are not made over the seam of a photoreceptor, and a thus a substantial gap between images is required at the seam. The unimaged portion of the paper must be cut out and discarded. For typical such print engines, up to 5% of the paper would thus become scrap. This level of paper scrap is not acceptable in high volume printing.

As will be discussed in more detail here, this problem may be overcome by lifting the transfer station and its associated segment of the web out of contact with the photoreceptor or other imaging surface each time the unimaged seam area 16*a* passes that transfer station, then reversing the web by a short movement backwards (upstream) distance, then re-accelerating the web forward (downstream) to match the imaging surface speed, then reengaging the imaging surface at the proper web registration position to transfer the next page image to the web directly following the previous page image without leaving an unprinted web area therebetween.

As further described elsewhere in this specification, for the illustrated duplex web printing systems, a web buffer loop such as 79 provided between the two transfer stations such as 72*a*, 72*b* expands by an amount equal to the number of pages that can be imaged onto the photoreceptor 16 or other imaging surface belt in one revolution of that belt. This enables the two transfer stations to change from transferring images from one side of the web to the other. Here, this is desirably done when the belt seam 16*a* passes, when the transfer stations would be required to lift off the belt in any case.

For systems not having a photoreceptor seam, the sequence described below can also be used advantageously, with more latitude in determining when to switch from imaging and transferring side one to imaging and transferring side two, and vice versa. Similarly, on systems having a seamed photoreceptor, the switch from imaging and transferring side one to imaging and transferring side 2 could be made more than once per revolution of the photoreceptor belt. For purposes of illustration, the operation will be described below for the case of switching from side one to side two transfer as the photoreceptor seam passes by the transfer area.

This disclosed embodiment for eliminating the scrap within a print job for continuous web duplex printing systems with a xerographic engine having a seamed photoreceptor thus has three basic elements: (1) a sequence of lifting the web off the photoreceptor each time the seam passes, backing up the web a short distance, re-accelerating the web to the photoreceptor speed, and re-engaging the web to the photoreceptor at a position where the lead edge of the first image past the photoreceptor seam abuts the trail edge of the last image transferred to the web prior to the photoreceptor seam; (2) an architecture which includes two transfer stations, for transferring images to each side for duplex imaging, and an operating sequence that stops transferring images to one side and starts transferring images to the other side at the other transfer station at a time coincident with the photoreceptor seam passing the transfer area; and (3) a buffer loop of paper between the two transfer stations that expands to absorb the number of images which can be made on a single revolution of the photoreceptor. This expansion distance may also vary as a function of the size of the images made. The loop expands to store images when the first side images are being transferred, and contracts to supply paper to the second side transfer station when the second side images are being transferred.

The preferred sequence of generating and transferring page images for long duplex run lengths can best be described as follows:

1. Image, develop, and transfer enough side one page images to fill the minimum web loop size (paper path segment length) between the two transfer stations. This value will be called "N" here. Depending upon how this web loop path is designed, typical values for N will be between 5 and 7 conventional letter sized page images (also called pitches). N will be somewhat variable due to image size differences. The first of this batch of plural N images must be placed on the photoreceptor belt 16 starting at N pitches prior to the belt seam 16*a*.

Note that prior to the start of any job, this image path between the transfer stations 72*a*, 72*b* will be filled with paper. (If print jobs are not piggybacked one directly after another, this length of paper becomes scrap, but only at the start of the print job.)

2. At this point, the seam 16*a* will pass below the side one transfer station. The side one transfer station 72*a* is lifted off the belt 16 as the seam 16*a* passes, the paper web 12 backs up a slight distance and re-accelerates in a forward direction to register the trail edge from the last image before the seam in an abutting relationship to the lead edge of the first image after the seam.

3. Print and transfer an additional "M" side one images onto the belt, with M equal to the number of complete abutted images that can be placed on the photoreceptor belt without imaging over the belt seam. The transferred images are stored in the paper web expansion loop 79 between the two transfer stations. M will be a variable, depending upon image size, and photoreceptor belt length. E.g., for a photoreceptor approximately 100 inches in circumference M could equal 11 pitches for letter size paper, with about 5 to 7 inches of photoreceptor left imaged at the belt seam.

4. At this point, the belt seam again passes the transfer stations, and the side one transfer station 72*a* must disengage similarly to the sequence described in step 2. The side two transfer station 72*b* now engages the photoreceptor at the first image after the seam 16*a* passes. While lifted off the photoreceptor, the paper web at the side one transfer station is reversed by the appropriate distance and then held in place for later re-engagement with the photoreceptor.

5. Next, M side two images are sequentially transferred onto paper supplied from the paper web expansion loop 79 located between the side one and side two transfer stations. These M side 2 images are transferred to the other side of the web from the locations where the first N side one images were previously transferred, plus the next M−N pitches of previously transferred side one images. Note that this leaves a total of N side one images still in the expansion loop after the expansion loop has been depleted to its minimum length paper path.

6. As the photoreceptor seam passes the transfer area, accelerate the paper in the side one transfer station to match up with the photoreceptor speed and move the side one transfer station onto the photoreceptor belt with the web at a position that enables the trail edge of last of the previously transferred side one images to abut the lead edge of the first post-seam image on the photoreceptor. Simultaneously, lift the side two transfer station off the photoreceptor belt, and reverse the web a short distance to enable later registration of subsequent side two images onto the web. Transfer an additional M side one images to the web.

7. Repeat steps 4 and 5 for side two transfer of M images.

8. Repeat steps 3 through 7 for each batch of M side one and M side two images until there are fewer than M side one images left on the job.

9. For the last (less than M) set of side one images, image all remaining side one images onto the photoreceptor and transfer them to the paper web at the side one transfer station.

It is noted that if the architecture of the print engine and its allowable transfer area allows the side two transfer station to be placed sufficiently downstream on the photoreceptor from the side one transfer station, a skip cycle may not be required after step 9 and before step 10. If the architecture requires that the transfer stations occupy roughly the same position on the photoreceptor, closely spaced, then a skip cycle may be required in order to disengage the side one transfer station and engage the side two transfer station.

10. Print all remaining side two images onto the photoreceptor (the last set of less than M images corresponding with the same set of side one images, plus the last N images), and engage the side two transfer station to transfer the last images to the web.

Note that for simplex, instead of duplex, web printing, one of the transfer stations may simply remain disengaged from the photoreceptor. All images are transferred at the one other transfer station to only one side of the web. Each time the seam passes the location of this transfer station, it disengages, reverses the web a short distance, re-accelerates the web to the photoreceptor speed, and re-engages in time to align the trail edge of the last image transferred prior to the seam with the lead edge of the first image after the seam.

Note also that the paper web path may remain exactly the same for simplex or duplex copying. For simplex copying, one of the two fusers may simply be disengaged by separating its rollers to open its nip. The other fuser then operates continuously. The paper supply roll also can operate continuously for simplex web printing. The two dancer loops will operate in a slightly different fashion to accommodate the speed differences. The dancer loops function as small paper buffers. The first dancer loop expands while the transfer station is disengaged from the photoreceptor such that the web motion is halted at the transfer station while the supply roll continues to rotate and supply paper. This loop then contracts while the transfer station is engaged and transferring images at process speed while the supply roll continues to supply paper at a speed slightly slower than process speed. The second dancer loop expands while the transfer station is engaged and the paper is moving at the photoreceptor speed at the transfer station, but at a slower speed at the fuser. When the transfer station is disengaged from the photoreceptor, and while the paper is being stopped, reversed and re-accelerated at the transfer station, the paper is supplied to the continuously operating fuser from the dancer loop.

The above sequences for duplex and simplex web printing eliminate paper scrap once a job has started running. In some instances there will be scrap paper before the job is started as the leader portion of the web negotiates the paper path (the length of web required to fill the minimum path with all dancer loops at their minimum path length.) This scrap could be eliminated by piggybacking one job onto another. But, more importantly, all scrap is eliminated once a job has started running.

These sequences also improve the efficiency of the print engine. The sequences described above provide the fewest skip cycles per job for maximum print engine efficiency. For example, on an engine designed for cut sheet operation, each image is typically followed by a 1 to 1.5 inch gap between the trail edge of that image and the lead edge of the next. A web feed version of that same engine requires that all images abut one another. Thus, the inter-image gap on the photoreceptor for cut sheet printing is eliminated, and more images can be made per revolution of the photoreceptor. For example, a cut sheet system with a photoreceptor belt designed for ten letter sized images per revolution at a 10 inch pitch can handle 11 images abutting one another at 8.5" pitch, and still have 5.5" of non-imaged area left over at the seam. (It is during that unused seam area that the transfer stations, as above, disengage, reverse and re-accelerate the web, and re-engage.) Accordingly, without changing the process speed, the same print engine will produce 10% more images per unit time at the same process speed.

An engine designed to make 135 pages per minute using cut sheets can thus make 148.5 pages per minute using a disclosed web fed system.

The subject duplex web printing sequence of switching from side one imaging to side two imaging as the seam passes enables an economy of mechanical motion, and limits the transfer station disengage/engage cycles to the absolute minimum necessary.

This system is also flexible in switching from simplex to duplex operation without requiring any operator action besides programming the jobs. For simplex printing, the finishing operations can be simplified for some jobs by eliminating inverting cycles for more reliable paper handling separations by using one transfer station to print on a first side if the job contains page sequences in ascending order, or, alternatively, using the other transfer station to print on the opposite side of the web if the job contains page sequences in reverse order. This will enable forward order collation of sets in either case (one face up in a collation station, the other face down) without requiring inversion of each sheet in either case. That is, this system allows a choice of which side of the web be printed, which determines side will be face up at the output.

Besides providing for automatic seam skipping, the disclosed system also provides frequent automatic re-registration correcting of accumulating registration errors due to speed miss-matches, paper web stretching, position control errors, etc. Since this system is printing relatively small batches (e.g., only 11 pages at a time) of side two images on the opposite side of a same size (relatively small) batch of side one images on a relatively short web segment which has previously passed through a fuser, the timing of the engagement of the two transfer stations can also be adjusted to correct for small expansions or contractions in the length of the paper web due to the influence of heat on the paper in that web segment, stretching of the paper, etc.

The above-disclosed system can thus eliminate paper scrap in a web fed system applied to a print engine with a seamed photoreceptor by lifting the web out of contact with the photoreceptor as the seam passes by, and simultaneously stopping the web motion, reversing the web, and re-accelerating it to engage the photoreceptor at process speed so as to abut the trail edge of the last image transferred prior to the seam with the lead edge of the first image to be transferred after the seam. This may be provided in an architecture which includes two transfer stations for transferring each side for duplex imaging, and an operating sequence that stops transferring one side and starts transferring the other side at the other transfer station at a time coincident with the photoreceptor seam passing the transfer area.

Variously disclosed in the above embodiments is an architecture and method for accomplishing two sided printing on a single imaging or print engine (xerographic or other) onto a continuous web. Some unusual disclosed elements include two separate but alligned transfer stations for transferring images to the web, one for each side, each capable of engaging and disengaging a photoreceptor or equivalent imaging surface; two separate fusers or fusing images on each side; a single photoreceptor or equivalent imaging surface print engine with an imaging system capable of imaging side one and side two images in alternate batches; a paper web inverter located between the two transfer stations to store side one images temporarily while they are being created and prior to advancing the portion of the web containing completed side one images to the side two transfer station. Also, a system and method of correcting accumulating registration errors (due to speed mis-matches, paper stretching, position control errors, etc.) on a xerographic or other print engine with a web paper feed system by intermittently disengaging the web from contact with the photoreceptor at at least one transfer station, correcting the web position, and later re-engaging the web with the photoreceptor. Also disclosed is a system and architecture which improves web control accuracy and reduces overall power requirements for web control by isolating the start/stop movement of a continuous paper web only to small low inertia segments of the web, and by providing web path expansion loops prior to side one and side two transfer stations.

While the embodiments disclosed herein are preferred, it will be appreciated from this teaching that various alternatives, modifications, variations or improvements therein may be made by those skilled in the art, which are intended to be encompassed by the following claims.

What is claimed is:

1. A web printing system for printing page images in continuous abutting relationship on a continuous web print substrate by transferring said page images to said continuous web print substrate from an endless surface imaging member while both are moving in a defined direction of movement at a process movement speed, wherein;

said endless surface imaging member has a minor seam area, said web printing system automatically provides a minor unimaged portion extending along said endless surface imaging member to encompass said seam area, with a defined beginning and end in said defined direction of movement, which unimaged portion is not imaged with said page images, said endless surface imaging member has a major portion which is imagable by said web printing system with plural said page images in continuous directly abutting relationship in said defined direction of movement; and said web printing system further includes at least one image transfer and web feed control system which automatically engages and disengages a minor portion of said continuous web from said endless surface imaging member with said continuous web for transferring said page images to said continuous web in said continuous abutting relationship.

2. The web printing system of claim 1, wherein said image transfer and web feed control system automatically disengages said minor portion of said continuous web from said endless surface imaging member at said beginning of said unimaged portion of said endless surface imaging member, then automatically reverses said minor portion of said continuous web by a short distance, and then automatically accelerates said minor portion of said continuous web to substantially match said process movement speed of said endless surface imaging member in said defined movement direction, and then automatically re-engages said minor portion of said continuous web with said endless surface imaging member at said end of said unimaged portion of said endless surface imaging member.

3. The web printing system of claim 1, wherein there are two said image transfer and web feed control systems, for printing opposite sides of said continuous web for duplex web printing.

4. The web printing system of claim 3, wherein said web printing system is alternately adapted for simplex printing of only one side of said continuous web, wherein said web printing system is adapted to form said page images as simplex page images on said major portion of said endless surface imaging member in both forward and reverse serial page order, wherein for simplex printing of said continuous web only a selected one of said two image transfer and web feed control systems is engaged with said endless surface imaging member for transferring said simplex page images to only one side of said continuous web, wherein one of said two image transfer and web feed control systems engages said endless surface imaging member with the first side of said continuous web when said page images are in said forward serial page order, and wherein the other of said two image transfer and web feed control systems engages said endless surface imaging member with the second side of said continuous web when said page images are in said reverse serial page order, to transfer said simplex page images from said endless surface imaging member to said continuous web in a desired output orientation.

5. The web printing system of claim 3, further including a duplex web feeding and inverting system providing inversion of said continuous web and an expanding and contracting length of web loop in said continuous web in between said two image transfer and web feed control systems for temporarily retaining a batch of plural said page images which have been transferred to one side of said continuous web, and wherein said web printing system generates controlled alternating sequences of plural said page images on said endless surface imaging member for opposite sides of said continuous web in sequential batches of sequential plural images for one side of said continuous web print substrate respectively alternating with plural said page images for said second side of said continuous web, respectively before and after said seam area, and coordinated with said expanding and contracting length web loop.

6. The web printing system of claim 5, wherein said sequential batches of plural said page images for one side of said continuous web are temporarily retained in said expanding and contracting length web loop and correspond in number to the number of said page images on said endless surface imaging member in one revolution of said endless surface imaging member.

7. The web printing system of claim 1, wherein said continuous web is continually fed by a continuous web print substrate supply system, and wherein said continuous web print substrate supply system and said image transfer and web feed control system are both an independent module undockable from said web printing system.

8. The web printing system of claim 1, wherein said image transfer and web feed control system additionally automatically repositions said continuous web to correct for web registration errors while said continuous web is so disengaged from said endless surface imaging member at said seam area.

9. In a web printing system for printing one or both of the first and second sides of a continuous web print substrate with a print engine having a revolving endless surface imaging member on which page print images are generated, said revolving endless surface imaging member having a defined direction of movement, by transferring said page print images from said endless surface imaging member of said print engine to said continuous web print substrate in a continuous sequence of directly adjacent said page print images, while said endless surface imaging member and said continuous web print substrate are moving in the same direction at substantially the same speed, the improvement comprising;

said endless surface imaging member comprising a photoreceptor belt with a belt seam area on which a page print image cannot be generated, said print engine providing an unimaged gap in said generated page images on said photoreceptor belt in said defined direction of movement for said belt seam area;

at least one image transfer station for image transfers of said page print images from said endless surface imaging member to at least one side of said continuous web print substrate, said image transfer station normally providing engagement of said continuous web print substrate with said endless surface imaging member, said image transfer station further providing automatic intermittent disengagement of said continuous web print substrate from said endless surface imaging member for at least said unimaged gap, and a continuous web print substrate supply system providing controlled feeding of said continuous web print substrate to said print engine endless surface imaging member at said image transfer station, said continuous web print substrate supply system and said image transfer station cooperating to prevent said unimaged gap in said generated page images on said photoreceptor belt from transferring to said continuous web print substrate, to provide said continuous sequence of directly adjacent said page print images on said continuous web print substrate.

10. The web printing system of claim 9, in which said continuous web print substrate supply system and said image transfer station cooperate to prevent said unimaged gap in said generated page print images on said photoreceptor belt from transferring to said continuous web print substrate by said automatic intermittent disengagement of said continuous web print substrate from said endless surface imaging member at said belt seam area, and intermittently interrupting the movement of said continuous web print substrate at said transfer station with said continuous web print substrate supply system during said disengagement.

11. The web printing system of claim 9, wherein there are two said image transfer stations, comprising first and second image transfer stations, for alternately respectively transferring said page print images directly from said photoreceptor belt to the first and second sides of said continuous web print substrate, and said continuous web print substrate supply system has a duplex web feeding and inverting system for feeding said continuous web print substrate into image transfer engagement with said photoreceptor belt twice, in said first and second image transfer stations respectively, with inversion of said continuous web print substrate between said first and second image transfer stations, and said first image transfer station transfers said page print images to said first side of said continuous web print substrate upstream of said belt seam area, then said first image transfer station automatically disengages said continuous web print substrate from said photoreceptor belt before said belt seam area passes said first image transfer station, and then said second image transfer station engages said continuous web print substrate to transfer said page print images to said second side of said continuous web print substrate after said belt seam area passes said second image transfer station.

12. The web printing system of claim 9, wherein said image transfer station automatically lifts the portion of said continuous web at said image transfer station out of contact with said photoreceptor as said photoreceptor belt seam passes by said transfer station, and said continuous web print substrate supply system automatically stops said continuous web motion at said transfer station, partially reverses said web, and re-accelerates said web to re-engage said photoreceptor at said speed thereof with the trail edge of the last page print image transferred to said web prior to said belt seam abutting the lead edge of the first page print image transferred to said web after said belt seam.

13. The web printing system of claim 11, wherein said first image transfer station stops transferring said page print images to said first side of said continuous web at a time coincident with said photoreceptor belt seam approaching said first transfer station, and said second image transfer station starts transferring said page print images to said second side of said web at a time coincident with said photoreceptor seam passing said second image transfer station.

14. The web printing system of claim 9, wherein said continuous web print substrate supply system providing said controlled feeding of said continuous web print substrate to said print engine endless surface imaging member at said image transfer station feeds said continuous web print substrate at a substantially constant speed from a large roll of said web print substrate, and wherein said continuous web print substrate supply system includes automatically variable length web loops in said endless web before and after said web image transfer station, with at least one said web loop being formed with a dancer roll system, to provide for intermittent interruption in said web movement in said image transfer station without interruption in said substantially constant speed feeding of said continuous web print substrate from said large roll thereof.

15. The web printing system of claim 1, wherein said image transfer and web feed control system includes at least one variable web length web loop in said continuous web print substrate, wherein said image transfer and web feed control system automatically disengages said continuous web from said endless surface imaging member adjacent to said defined beginning of said unimaged portion of said endless surface imaging member for movement of said unimaged portion of said endless surface imaging member relative to said continuous web, wherein said image transfer and web feed control system automatically varies said variable web length web loop to vary the movement distance of said continuous web relative to said endless surface imaging member by an amount corresponding to said unimaged portion of said endless surface imaging member by temporarily varying the movement of said continuous web, and wherein said image transfer and web feed control system automatically re-engages said web with said endless surface imaging member at said end of said unimaged portion of said endless surface imaging member, so that said page images are transferred to said continuous web in said continuous abutting relationship.

* * * * *